US009909245B2

(12) United States Patent
Obregon

(10) Patent No.: US 9,909,245 B2
(45) Date of Patent: Mar. 6, 2018

(54) METHODS FOR CONTROLLING ADDITIVE DEPOSITION IN WASHING MACHINE APPLIANCES

(71) Applicant: General Electric Company, Schenectady, NY (US)

(72) Inventor: Roberto Obregon, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 126 days.

(21) Appl. No.: 14/849,738

(22) Filed: Sep. 10, 2015

(65) Prior Publication Data

US 2017/0073870 A1 Mar. 16, 2017

(51) Int. Cl.
*D06F 33/02* (2006.01)
*D06F 39/02* (2006.01)

(52) U.S. Cl.
CPC ..... *D06F 33/02* (2013.01); *D06F 39/022* (2013.01); *D06F 2202/06* (2013.01); *D06F 2204/02* (2013.01); *D06F 2204/084* (2013.01); *D06F 2204/086* (2013.01); *D06F 2220/00* (2013.01)

(58) Field of Classification Search
CPC .... D06F 33/02; D06F 39/022; D06F 2202/06; D06F 2204/084; D06F 2204/086; D06F 2204/02; D06F 2220/00
See application file for complete search history.

(56) References Cited

U.S. PATENT DOCUMENTS

| | | | | |
|---|---|---|---|---|
| 6,143,257 | A | 11/2000 | Spriggs et al. | |
| 6,160,245 | A | 12/2000 | Broker et al. | |
| 2002/0017793 | A1* | 2/2002 | Spiessl | D06F 37/42 292/341.16 |
| 2008/0045431 | A1 | 2/2008 | Corradini | |
| 2011/0239711 | A1* | 10/2011 | Bostjan | A47L 15/4259 70/91 |
| 2012/0279261 | A1* | 11/2012 | Ka | D06F 39/14 68/12.04 |

(Continued)

OTHER PUBLICATIONS

Gagliardi, Mary; "*Issue with your Wahser's bleach dispenser*?"; https://www.clorox.com/dr-laundry/issues-with-your-washers-bleach-dispenser/ Printed Aug. 31, 2015 (6 pages).

*Primary Examiner* — Joseph L Perrin
(74) *Attorney, Agent, or Firm* — Dority & Manning, P.A.

(57) ABSTRACT

A method for controlling additive deposition in a washing machine appliance includes transmitting, after a first agitation of a load within a tub of the washing machine appliance, an additive deposition signal to a user of the washing machine appliance. The method further includes beginning a timer, the timer set to run for a predetermined time period. The method further includes determining whether a door of the washing machine appliance has been opened after transmitting the additive deposition signal and during the predetermined time period. The method further includes determining whether the door has been closed when the door has been opened during the predetermined time period, and performing a second agitation of the load when the door has been closed. The method further includes performing the second agitation when the door has not been opened during the predetermined time period after the predetermined time period has been reached.

10 Claims, 4 Drawing Sheets

(56) References Cited

U.S. PATENT DOCUMENTS

| | | | | |
|---|---|---|---|---|
| 2012/0284930 | A1* | 11/2012 | Robertson | D06F 35/00 8/137 |
| 2013/0271259 | A1* | 10/2013 | Brasseur | D06F 39/005 340/4.31 |
| 2016/0348293 | A1* | 12/2016 | Kawaguchi | D06F 35/00 |

* cited by examiner

METHODS FOR CONTROLLING ADDITIVE DEPOSITION IN WASHING MACHINE APPLIANCES

FIELD OF THE INVENTION

The present disclosure relates generally to washing machine appliances, and more particularly to methods for controlling the deposition of additives such as bleach in washing machine appliances.

BACKGROUND OF THE INVENTION

Washing machine appliances generally include a cabinet which supports a tub for containing wash fluid, e.g., water and detergent, bleach and/or other wash additives. A basket is mounted within the tub and defines a wash chamber for receipt of a load of articles for washing. During operation of such washing machine appliances, wash fluid is directed into the tub and onto articles within the wash chamber of the basket. The basket or an agitation element can rotate at various speeds to agitate articles within the wash chamber in the wash fluid, to wring wash fluid from articles within the wash chamber, etc.

The wash fluid utilized in a washing machine appliance typically includes water and a detergent, and can further include various additives such as bleach. The additives are generally added to enhance the cleaning or other properties of the wash fluid. Typically an additive is added to an additive dispenser of the washing machine appliance, and then flowed from the additive dispenser to mix with the wash fluid.

In some washing machine appliances, the additives can be initially added to the additive dispenser before starting operation of the washing machine appliance. In these cases, the additive dispenser can hold the additives until a desired time during the wash cycle during which the additive is to be added to the wash fluid. The dispenser can then automatically release the additive at the desired time to mix with the wash fluid.

In other washing machine appliances, however, additives added to the additive dispenser are immediately flowed through the dispenser to the tub. Accordingly, for additives such as bleach which are desirably not added to the wash fluid until a portion of the wash cycle has been performed, a user of the washing machine appliance is required to know when during the cycle to add the additive to the dispenser and to remember to do so.

Accordingly, improved washing machine appliances are desired in the art. In particular, washing machine appliances with improved functionality for controlling additive deposition, in particular in washing machine appliances in which additives are directly flowed through the dispenser to the tub, would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, a method for controlling additive deposition in a washing machine appliance is provided. The method includes transmitting, after a first agitation of a load within a tub of the washing machine appliance, an additive deposition signal to a user of the washing machine appliance. The method further includes beginning a timer, the timer set to run for a predetermined time period. The method further includes determining whether a door of the washing machine appliance has been opened after transmitting the additive deposition signal and during the predetermined time period. The method further includes determining whether the door has been closed when the door has been opened during the predetermined time period, and performing a second agitation of the load when the door has been closed. The method further includes performing the second agitation when the door has not been opened during the predetermined time period after the predetermined time period has been reached.

In accordance with another embodiment, a washing machine appliance is provided. The washing machine appliance includes a cabinet, a tub positioned within the cabinet, and a basket rotatably mounted within the tub, the basket defining a chamber for receipt of a load of items for washing. The washing machine appliance further includes a door for providing access to the tub, an annulus defined between the tub and the basket, an additive dispenser in fluid communication with the annulus, a water inlet for flowing water into the tub, and a controller. The controller configured for transmitting, after a first agitation of a load within a tub of the washing machine appliance, an additive deposition signal to a user of the washing machine appliance. The controller is further configured for beginning a timer, the timer set to run for a predetermined time period. The controller is further configured for determining whether a door of the washing machine appliance has been opened after transmitting the additive deposition signal and during the predetermined time period. The controller is further configured for determining whether the door has been closed when the door has been opened during the predetermined time period, and performing a second agitation of the load when the door has been closed. The controller is further configured for performing the second agitation when the door has not been opened during the predetermined time period after the predetermined time period has been reached.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
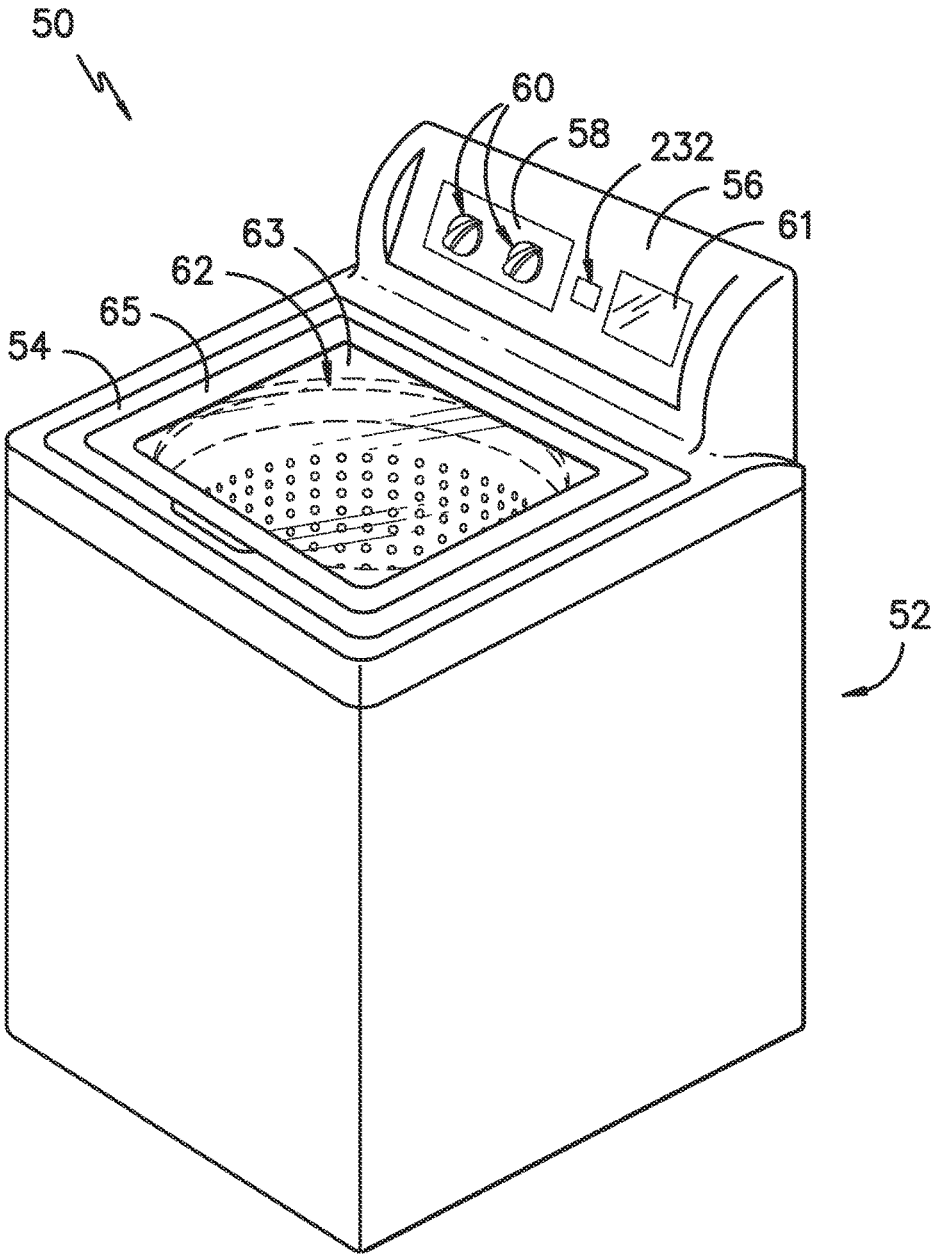
FIG. 1 provides a front perspective view of a washing machine appliance according to an exemplary embodiment of the present subject matter, with a door in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A door 62 is mounted to cover 54 and is rotatable between an open position (not shown) facilitating access to a wash tub 64 (FIG. 2) located within cabinet 52 and a closed position (shown in FIG. 1) forming an enclosure over tub 64.

Door 62 in exemplary embodiment includes a transparent panel 63, which may be formed of for example glass, plastic, or any other suitable material. The transparency of the panel 63 allows users to see through the panel 63, and into the tub 64 when the door 62 is in the closed position. In some embodiments, the panel 63 may itself generally form the door 62. In other embodiments, the door 62 may include the panel 63 and a frame 65 surrounding and encasing the panel 63. Alternatively, panel 63 need not be transparent.

Figure 2:
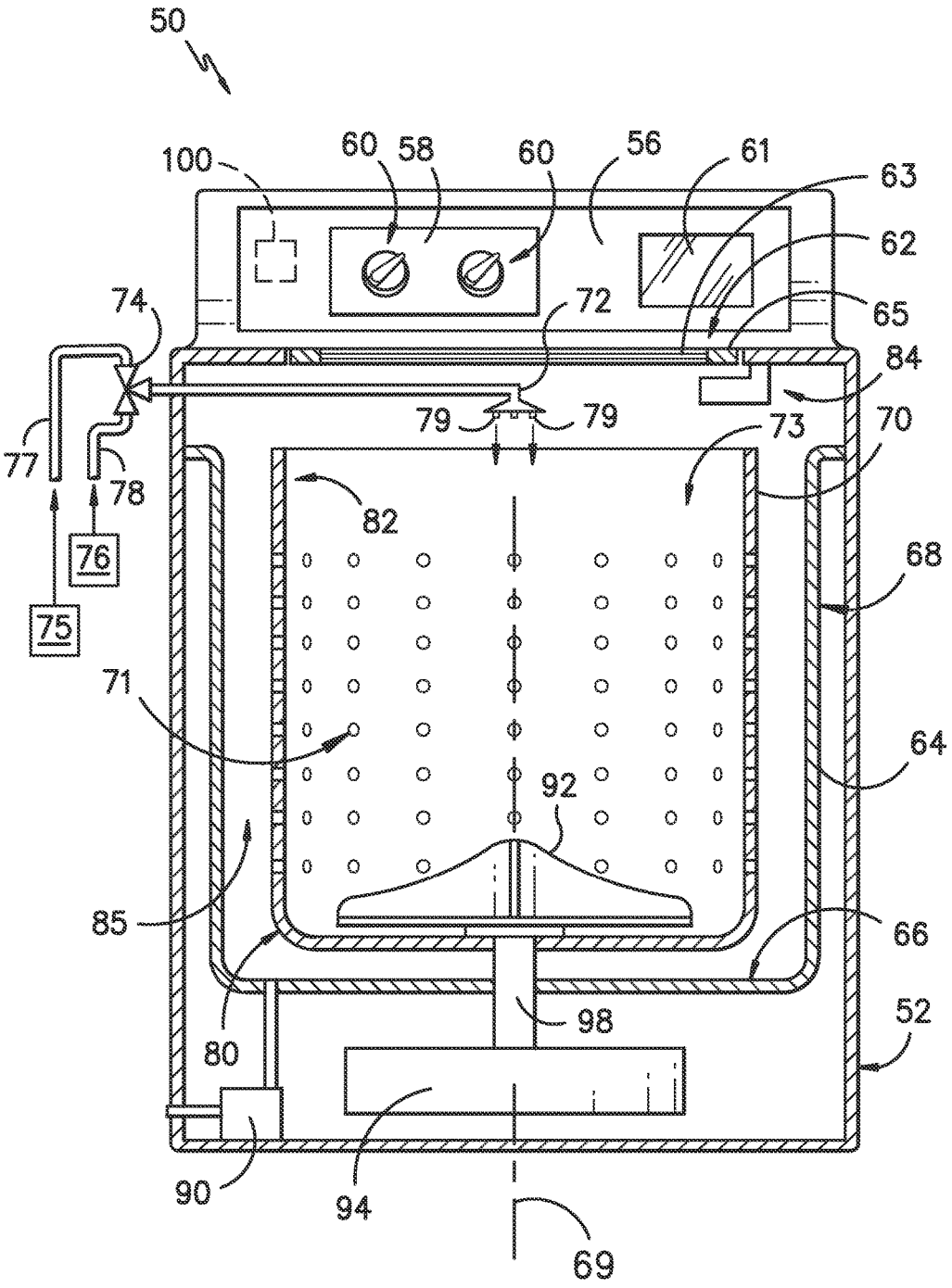
FIG. 2 provides a front cross-sectional view of a washing machine appliance according to an exemplary embodiment of the present subject matter.

FIG. 2 provides a front, cross-section view of washing machine appliance 50. As may be seen in FIG. 2, tub 64 includes a bottom wall 66 and a sidewall 68. A wash drum or wash basket 70 is rotatably mounted within tub 64, defining an annulus 85 between the tub 64 and basket 70. In particular, basket 70 is rotatable about a central axis 69, which may when properly balanced and positioned in the embodiment illustrated be a vertical axis. Thus, washing machine appliance is generally referred to as a vertical axis washing machine appliance. Basket 70 defines a wash chamber 73 for receipt of a load of articles for washing and extends, e.g., vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent top portion 82 of basket 70. Nozzle 72 may be in fluid communication with one or more water sources 75, 76 in order to direct liquid (e.g. water) into tub 64 and/or onto articles within chamber 73 of basket 70. Nozzle 72 may further include apertures 79 through which water may be sprayed into the tub 64. Apertures 79 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed, i.e. sprayed or poured, into the tub 64.

A main valve 74 regulates the flow of liquid through nozzle 72. For example, valve 74 can selectively adjust to a closed position in order to terminate or obstruct the flow of liquid through nozzle 72. The main valve 74 may be in fluid communication with one or more external liquid sources, such as a cold water source 75 and a hot water source 76. The cold water source 75 may, for example, be a commercial water supply, while the hot water source 76 may be, for example, a water heater. Such external water sources 75, 76 may supply water to the appliance 50 through the main valve 74. A cold water conduit 77 and a hot water conduit 78 may supply cold and hot water, respectively, from the sources 75, 76 through valve 74. Valve 74 may further be operable to regulate the flow of hot and cold liquid, and thus the temperature of the resulting liquid flowed into tub 64, such as through the nozzle 72.

An additive dispenser 84 may additionally be provided for directing an additive, such as detergent, bleach, liquid fabric softener, etc., into the tub 64. As illustrated, dispenser may be in fluid communication with annulus 85, such that additive added to the dispenser 84 may flow directly from the dispenser 84 into the annulus 85. In alternative embodiments, dispenser may be in fluid communication with nozzle 72 such that water flowing through nozzle 72 flows through dispenser 84, mixing with additive at a desired time during operation to form a liquid or wash fluid, before being flowed into tub 64. In still other alternative embodiments, nozzle 72 and dispenser 84 may be integral, with a portion of dispenser 84 serving as the nozzle 72.

A pump assembly 90 (shown schematically in FIG. 2) is located beneath tub 64 and basket 70 for gravity assisted flow to drain tub 64. An agitation element 92, shown as an impeller in FIG. 2, may be disposed in basket 70 to impart an oscillatory motion to articles and liquid in chamber 73 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 92 is oriented to rotate about vertical axis V. Alternatively, basket 70 may provide such agitating movement, and agitation element 92 is not required. Basket 70 and agitation element 92 are driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64, e.g., about vertical axis V. Washing machine appliance 50 may also include a brake assembly (not shown) selectively applied or released for respectively maintaining basket 70 in a stationary position within tub 64 or for allowing basket 70 to spin within tub 64.

Operation of washing machine appliance 50 is controlled by a processing device or controller 100, that is operatively coupled to the input selectors 60 located on washing machine backsplash 56 (shown in FIG. 1) for user manipulation to select washing machine cycles and features. Controller 100 may further be operatively coupled to various other components of appliance 50, such as main valve 74, pump assembly 90, motor 94, and other suitable sensors, etc. In response to user manipulation of the input selectors 60, controller 100 may operate the various components of washing machine appliance 50 to execute selected machine cycles and features.

Controller 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50, such as the door 62, pump assembly 90, motor 94, valve 74, etc. may be in communication with controller 100 via one or more signal lines or shared communication busses.

In an illustrative embodiment, a load of laundry articles are loaded into chamber 73 of basket 70, and washing operation is initiated through operator manipulation of control input selectors 60. Tub 64 is filled with liquid, such as water, and may be mixed with detergent to form a wash fluid. Main valve 74 can be opened to initiate a flow of liquid and resulting wash fluid into tub 64 via nozzle 72, and tub 64 can be filled to the appropriate level for the amount of articles being washed. Once tub 64 is properly filled with wash fluid, the contents of the basket 70 are agitated with agitation element 92 or by movement of the basket 70 for cleaning of articles in basket 70. More specifically, agitation element 92 or basket 70 is moved back and forth in an oscillatory motion.

After the agitation phase of the wash cycle is completed, tub 64 is drained, such as through use of pump assembly 90. Laundry articles can then be rinsed by again adding fluid to tub 64. Depending on the particulars of the cleaning cycle selected by a user, agitation element 92 or basket 70 may again provide agitation within basket 70. After a rinse cycle, tub 64 is again drained, such as through use of pump assembly 90. Further, in exemplary embodiments, one or more extractions, or spin cycles, may be performed. In particular, a spin cycle may be applied after the wash cycle(s) and/or after the rinse cycle(s) in order to wring excess wash fluid from the articles being washed. During a spin cycle, basket 70 is rotated at relatively high speeds, as discussed further herein.

While described in the context of specific embodiments of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
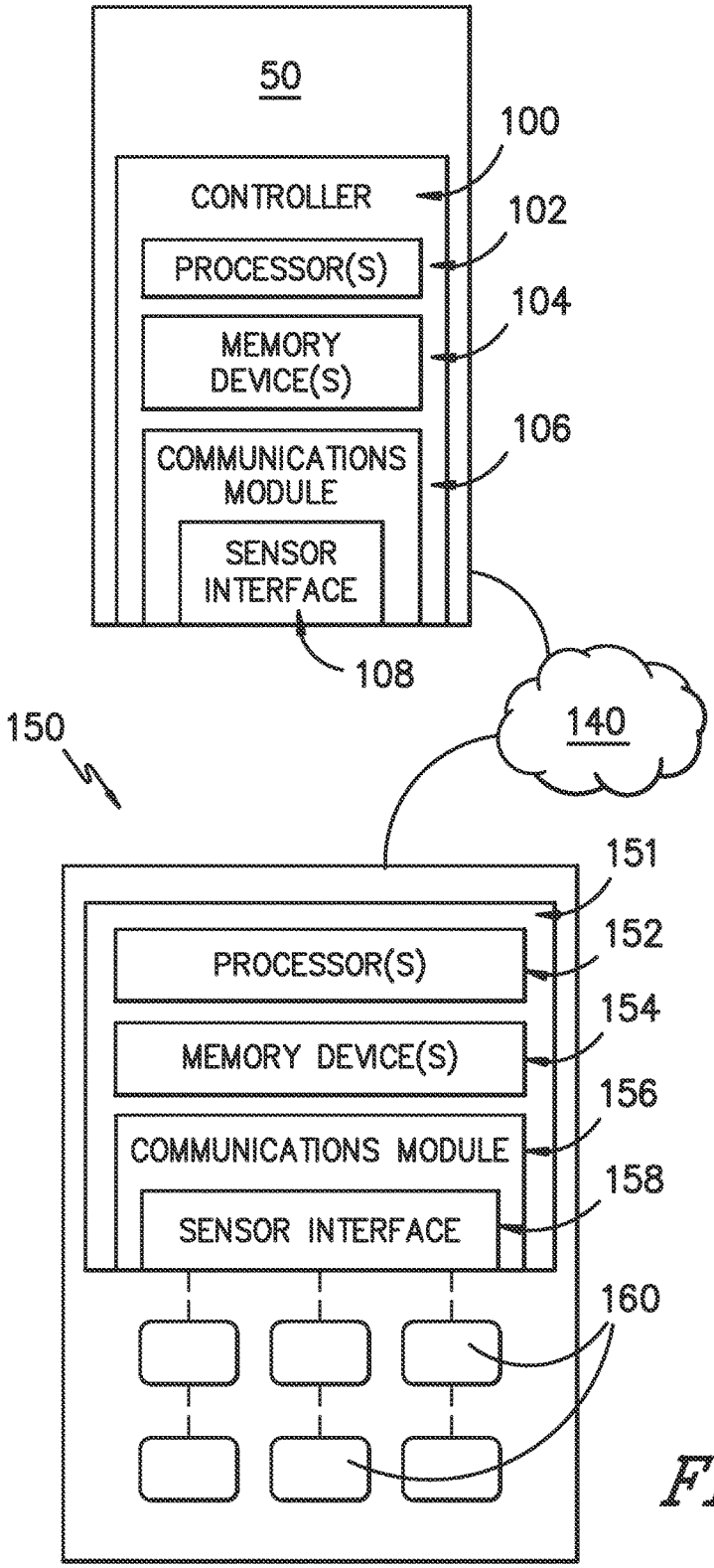
FIG. 3 is a schematic diagram of a controller of a washing machine appliance and a user interface device according to an exemplary embodiment of the present subject matter.

Referring briefly to FIG. 3, one embodiment of controller 100 is schematically illustrated. Controller 100 may include one or more processor(s) 102 and associated memory device (s) 104 configured to perform a variety of computer-implemented functions (e.g., performing the methods, steps, and the like disclosed herein). Additionally, the controller 100 may also include a communications module 106 to facilitate communications between the controller 100 and various other components, such as a user interface device as discussed herein. For instance, the communications module 106 may serve as an interface to permit the controller 100 to transmit and/or receive signals, such as those discussed herein. Moreover, the communications module 106 may include an interface 108 (e.g., one or more analog-to-digital converters) to permit input signals to be converted into signals that can be understood and processed by the processor 102.

In some embodiments as further illustrated in FIG. 3, the controller 100 may be in communication with an independent user interface device 150. The user interface device 150 may be in communication (such as wireless communication) with the controller 100, such as through a network 140. The network 140 may be any type of wireless communications network, such as a local area network (e.g. intranet), wide area network (e.g. Internet), or some combination thereof. The network 140 can also include a direct connection between the client devices, such as controller 100 and user interface device 150. In general, communication through the network 140 may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP, SSL). Accordingly, wash control information may be transmitted from the controller 100 to the user interface device 150 and from the user interface device 150 to the controller 100 (and received thereby) using the network 140.

The user interface device 150 may provide the user with access to information related to operation of the washing machine appliance 50, include the status of a wash cycle in process. In particular as discussed herein, the user interface device 150 may receive signals related to the status of the wash cycle. The user interface device 150 in exemplary embodiments is independent from the washing machine appliance 50, and may in some embodiments be, for example, a computer (such as a desktop computer or a laptop), a tablet, a personal telephone (such as a suitable smartphone), or an independent device which functions solely to operate and communicate with the washing machine appliance 50.

User interface device 150 may include a controller 151. The controller 151 may include one or more processor(s) 152 and associated memory device(s) 154 configured to perform a variety of computer-implemented functions (e.g., performing the methods, steps, and the like disclosed herein). Additionally, the controller 151 may also include a communications module 156 to facilitate communications between the device 150 and the controller 100. For instance, the communications module 156 may serve as an interface to permit the controller 151 to transmit and/or receive signals to/from the controller 100. Moreover, the communications module 156 may include an interface 158 (e.g., one or more analog-to-digital converters) to permit input signals to be converted into signals that can be understood and processed by the processor 152. The interface 158 may include or be in communication with input selectors 160 of the device 150, through which a user may provide various inputs are desired.

Figure 4:
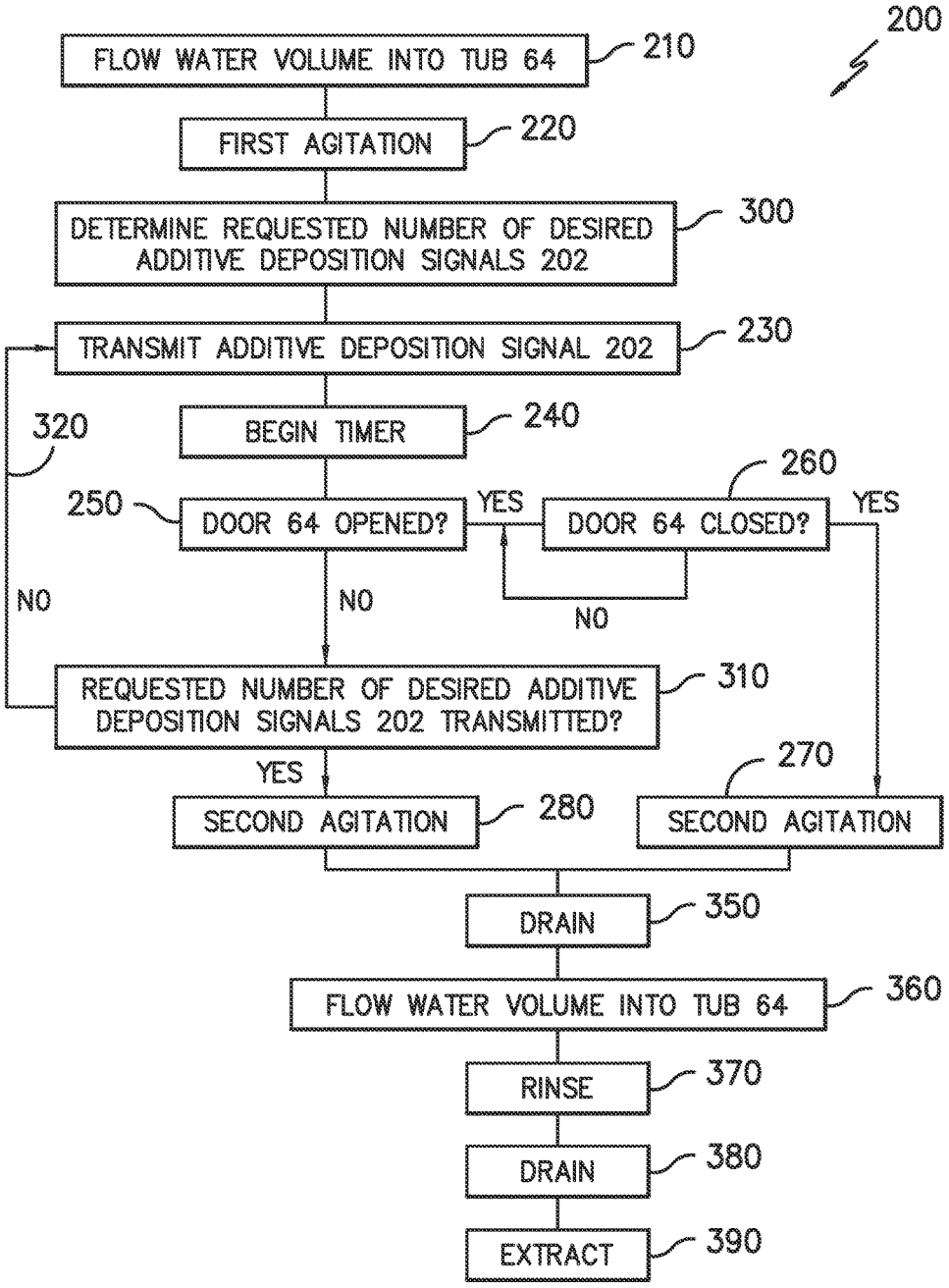
FIG. 4 is a flow chart illustrating a method according to an exemplary embodiment of the present subject matter.

Referring now to FIG. 4, various methods may be provided for use with washing machine appliances 50 in accordance with the present disclosure. In general, the various steps of methods as disclosed herein may in exemplary embodiments be performed by the controller 100, which may receive inputs and transmit outputs from various other components of the appliance 50 and/or to a user interface device 150. In particular, the present disclosure is further directed to methods, as indicated by reference number 200, for controlling additive deposition in washing machine appliances 50.

Method 200 may include, for example, the step 210 of flowing a water volume into the tub 64. For example, the water volume may be flowed through valve 74 as discussed herein. Such step may, for example, begin the wash cycle of the washing machine appliance 50, and be performed after a user provides various inputs to the appliance 50, i.e. via the control panel 58 and input selectors 60, to select for example a desired wash program (normal, heavy duty, delicates, etc.), a desired program modifier (water temperature, soil level, spin speed, fabric softener, etc.), etc. One particular input that may be provided by a user is a requested number of desired additive deposition signals 202, as discussed herein. For example, the user may select 0, 1, 2, 3, 4 or more as the requested number of desired additive deposition signals 202.

Method 200 may further include the step 220 of performing a first agitation of a load of articles within the tub 64, such as within the basket 70. Such step 220 may occur, for example, after step 210. Further, such step 220 may occur after a detergent has been added to the tub 64, such as via dispenser 84, by hand, or via another suitable delivery apparatus or method.

The first agitation generally agitates the articles and wash fluid, including the water volume and detergent, within the tub 64. In some embodiments, such step 220 may include rotating the basket 70 in the first agitation. Alternatively, such step 220 may include rotating the agitation element 92 relative to basket 70, as discussed herein. Such rotation may include various steps of rotating and/or holding stationary to allow articles within the wash chamber 73 to soak within the wash fluid. For example, such rotation may include alternately rotating in opposite directions, such as clockwise, then counterclockwise, then clockwise, etc. Each rotation may occur for between approximately 1 second and approximately 3 seconds, followed by a brief hold (i.e. between 0.01 and approximately 2 seconds) during which the direction of rotation is changed. The rotations may be performed at any suitable speeds, such as for example less than or equal to approximately 150 revolutions per minute ("RPM"), such as less than or equal to approximately 130 RPM. Further, additional or alternative patterns of rotation (at any suitable speeds) and/or holding may be utilized in a first agitation as desired or required.

The first agitation may be performed for a predetermined time period. In exemplary embodiments, the predetermined time period may be between approximately 10 minutes and approximately 30 minutes, such as between approximately 15 and approximately 25 minutes.

Method 200 may further include the step 230 of transmitting an additive deposition signal 202 to a user of the washing machine appliance 50. Such step 230 may occur, for example, after step 220. In particular, it should be noted that in exemplary embodiments when the transmitting step 230 occurs, any rotation of the basket 70 or agitation element 92 is paused until a subsequent agitation as discussed herein.

The additive deposition signal 202 may be a signal to the user that an additive, such as in exemplary embodiments bleach, should be added to the tub 64 for mixing with the wash fluid therein. Notably, the signal is transmitted after step 220, such that an initial fill and agitation occurs before adding of the additive. The signal thus occurs at a desired time for adding of the additive to the wash fluid.

In some embodiments, the signal is transmitted to a signal output device 232 of the washing machine appliance 50, which may for example, be included in the control panel 58. For example, the signal output device 232 may be a portion of the display 61, or may be a separate device 232 devoted to providing an output for the signal 202. The signal output device 232 may emit an alert when the signal 202 is received. The alert may, for example, be auditory and/or visual. Accordingly, the device 232 may, for example, be a speaker or a light.

In other embodiments, the signal is transmitted to a user interface device 150, as discussed above. The user interface device 150 may emit an alert when the signal 202 is received. The alert may, for example, be a text message, a ring, or another suitable auditory and/or visual alert.

Method 200 may further include, for example, the step 240 of beginning a timer. Such step may occur, for example, upon transmission of the signal 202. The timer may, for example, be integrated into controller 100. The timer may be set to run for a predetermined time period. The predetermined time period may, for example, be between approximately 15 seconds and approximately 5 minutes, such as between approximately 20 seconds and approximately 3 minutes, such as between approximately 30 seconds and approximately 2 minutes, such as between approximately 40 seconds and approximately 1 minute.

Method 200 may further include, for example, the step 250 of determining whether the door 62 has been opened. Such step may occur after step 220 and during the predetermined time period. An indication that the door 62 has been opened in such manner is utilized in accordance with the present disclosure as an indication to, for example, the controller 100, that the user is adding the additive to the tub 64 after the signal 202 has been transmitted.

Method 200 may further include, for example, the step 260 of determining whether the door 62 has been closed when the door 62 has been opened during the determined time period. An indication that the door 62 has been closed in such manner is utilized in accordance with the present disclosure as an indication to, for example, the controller 100, that the user has completed adding the additive to the tub 64 after the signal 202 has been transmitted.

Method 200 may further include, for example, the step 270 of performing a second agitation of the load when the door has been closed. The second agitation generally agitates the articles and wash fluid, including the water volume and detergent, within the tub 64. In some embodiments, such step 220 may include rotating the basket 70 in the second agitation. Alternatively, such step 220 may include rotating the agitation element 92 relative to basket 70, as discussed herein. Such rotation may include various steps of rotating and/or holding stationary to allow articles within the wash chamber 73 to soak within the wash fluid. For example, such rotation may include alternately rotating in opposite directions, such as clockwise, then counterclockwise, then clockwise, etc. Each rotation may occur for between approximately 1 second and approximately 3 seconds, followed by a brief hold (i.e. between 0.01 and approximately 2 seconds) during which the direction of rotation is changed. The rotations may be performed at any suitable speeds, such as for example less than or equal to approximately 150 revolutions per minute ("RPM"), such as less than or equal to approximately 130 RPM. Further, additional or alternative patterns of rotation (at any suitable speeds) and/or holding may be utilized in a second agitation as desired or required.

The second agitation may be performed for a predetermined time period. In exemplary embodiments, the predetermined time period may be between approximately 2 minutes and approximately 10 minutes, such as between approximately 3 and approximately 5 minutes.

Method 200 may further include, for example, the step 280 of performing the second agitation (as discussed herein) when the door 62 has not been opened during the predetermined time period after the predetermined time period has been reached. Accordingly, after the predetermined time period has expired, it is assumed by, for example, the controller 100, that the user no longer wishes to add an additive during the wash cycle, and the wash cycle is continued.

Method 200 may further include, for example, the step 300 of determining a requested number of desired additive deposition signals 202. For example, the requested number of signals 202 may, as discussed herein, be user selectable. Upon selection of a requested number of signals 202, this requested number may, for example, be transmitted to the controller 100. Such step 300 may, for example, occur before the transmitting step 230.

Method 200 may further include, for example, the step 310 of determining whether the requested number of desired additive depositions signals have been transmitted. Such step may, for example, occur after the predetermined time period has been reached and before step 280. If the requested number of signals 202 have been transmitted, the method 200 may proceed to step 280. In accordance with a further step 320, if the requested number of signals 202 have not been transmitted, the transmitting step 230 (as well as steps 240, 250, 260 and/or 270) may be repeated.

Accordingly, methods in accordance with the present disclosure advantageously provide washing machine appliances 50 with improved functionality for controlling additive deposition, in particular in washing machine appliances 50 in which additives are directly flowed through the dispenser 84 to the tub 64. Such improved functionality is advantageously provided by use of additive deposition signals 202 to alert the user to the proper time to dispense the desired additive into the tub 64 during a wash cycle, as discussed herein.

Method 200 may further include additional steps which may be utilized to complete the wash cycle. For example, method 200 may further include the step 350 of draining water (as well as detergent and additive) from the tub 64. Such step 350 may occur, for example, after step 280. Pump assembly 90 may, for example, be utilized for such draining. Method 200 may further include, for example, the step 360 of flowing a subsequent water volume into the tub 64. Such step 360 may occur, for example, after step 350.

Method 200 may further include the step 370 of performing a third agitation, which may also be referred to as a rinse of the load. Such step 370 may occur, for example, after step 360. The third agitation cycle generally agitates the articles and wash fluid within the tub 122. In some embodiments, such step 370 may include rotating the basket 70. Alternatively, such step 370 may include rotating the agitation element 92 relative to basket 70. Such rotation may include various steps of rotating and/or holding stationary to allow articles within the wash chamber 73 to soak within the wash fluid. For example, such rotation may include alternately rotating in opposite directions, such as clockwise, then counterclockwise, then clockwise, etc. Each rotation may occur for between approximately 1 second and approximately 3 seconds, followed by a brief hold (i.e. between 0.01 and approximately 2 seconds) during which the direction of rotation is changed. The rotations may be performed at any suitable speeds, such as for example less than or equal to approximately 150 revolutions per minute ("RPM"), such as less than or equal to approximately 130 RPM. Further, additional or alternative patterns of rotation (at any suitable speeds) and/or holding may be utilized in a third agitation as desired or required.

The third agitation, or rinse, may be performed for a predetermined time period. In exemplary embodiments, the predetermined time period may be between approximately 5 minutes and approximately 20 minutes, such as between approximately 5 and approximately 15 minutes.

Method 200 may further include the step 380 of draining water (as well as detergent and additive) from the tub 64. Such step 380 may occur, for example, after step 370. Pump assembly 90 may, for example, be utilized to for such draining.

Method 200 may further include the step 390 of performing an extraction of water (as well as detergent and additive) from the tub 64. Such step may occur after step 350, and may further occur after step 380. In exemplary embodiments, such step 226 may include rotating the basket 70 in an extraction cycle. The extraction may extract water (as well as detergent and additive) from the articles within the wash chamber 73. Rotation of the basket 70 in the extraction cycle may occur for example at a generally higher speed than any of the agitation cycles discussed herein, such as for example between approximately 300 RPM and approximately 1200 RPM. A predetermined time period for the first extraction cycle may, for example, be between approximately 5 minutes and approximately 15 minutes.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for controlling a washing machine appliance, the method comprising:

transmitting, after a first agitation of a load within a tub of the washing machine appliance, an additive deposition signal to a user of the washing machine appliance;

beginning a timer in response to transmitting the additive deposition signal, the timer set to run for a predetermined time period following transmitting the additive deposition signal;

determining whether a door of the washing machine appliance has been opened after transmitting the additive deposition signal and during the predetermined time period;

determining whether the door has been closed when the door has been opened during the predetermined time period; and performing a second agitation of the load in response to one of a plurality of conditions, the plurality of conditions comprising the door has been closed if it has been determined that the door of the washing machine appliance has been opened after transmitting the additive deposition signal, and the door has not been opened during the predetermined time period after the predetermined time period has been reached.

2. The method of claim 1, further comprising determining a requested number of additive deposition signals based on a signal received at a controller.

3. The method of claim 2, wherein the requested number of additive deposition signals is based on a number of signal input at a user interface device.

4. The method of claim 2, further comprising:

determining, after the predetermined time period has been reached and before performing the second agitation of the load, whether each of the requested number of additive deposition signals have been transmitted; and repeating the transmitting step if each of the requested number of additive deposition signals have not been transmitted.

5. The method of claim 1, wherein the additive deposition signal is transmitted to a signal output device of the washing machine appliance.

6. The method of claim 1, wherein the additive deposition signal is transmitted to a user interface device.

7. The method of claim 1, further comprising:

flowing a water volume into the tub; and performing the first agitation of the load.

8. The method of claim 7, further comprising:

draining water from the tub after performing the second agitation; and performing an extraction of water from the load.

9. The method of claim 8, further comprising:

flowing a water volume into the tub after draining water from the tub;

performing a rinse of the load; and draining water from the tub.

10. The method of claim 1, wherein the additive is bleach.

* * * * *